US005779389A

United States Patent [19]

Niemerski

[11] Patent Number: 5,779,389

[45] Date of Patent: Jul. 14, 1998

[54] DEFORMABLE IMPACT TEST BARRIER

[75] Inventor: Michael C. Niemerski, Jenison, Mich.

[73] Assignee: Plascore, Inc., Zeeland, Mich.

[21] Appl. No.: 820,104

[22] Filed: Mar. 19, 1997

Related U.S. Application Data

[63] Continuation-in-part of Ser. No. 536,058, Sep. 29, 1995, Pat. No. 5,620,276.

[51] Int. Cl.[6] ..... E01F 13/00

[52] U.S. Cl. ..... 404/6; 404/9; 404/10; 256/1; 256/13.1; 428/116

[58] Field of Search ..... 404/6, 9, 10; 256/1, 256/13.1; 52/783.11, 783.14, 783.17, 784.14, 786.13, 793.1; 428/116

[56] References Cited

U.S. PATENT DOCUMENTS

| | | | |
|---|---|---|---|
| 2,870,857 | 1/1959 | Goldstein | 181/33 |
| 3,130,819 | 4/1964 | Marshall | 188/1 |
| 3,552,525 | 1/1971 | Schudel | 188/1 |
| 3,757,562 | 9/1973 | Goldberg | 73/12 |
| 3,910,374 | 10/1975 | Holehouse | 181/33 G |
| 3,948,346 | 4/1976 | Schindler | 181/33 G |
| 4,029,350 | 6/1977 | Goupy | 293/71 R |
| 4,154,469 | 5/1979 | Goupy | 293/120 |
| 4,271,219 | 6/1981 | Brown | 428/116 |
| 4,336,292 | 6/1982 | Blair | 428/116 |
| 4,352,484 | 10/1982 | Gertz | 256/13.1 |
| 4,421,811 | 12/1983 | Rose | 428/116 |
| 4,465,725 | 8/1984 | Riel | 428/116 |
| 4,475,624 | 10/1984 | Bourland | 181/292 |
| 4,524,603 | 6/1985 | Hargunani | 73/12 |
| 5,041,323 | 8/1991 | Rose | 428/116 |
| 5,052,732 | 10/1991 | Oplet | 293/102 |
| 5,106,668 | 4/1992 | Turner | 428/116 |
| 5,180,619 | 1/1993 | Landi | 428/116 |

FOREIGN PATENT DOCUMENTS 678223 8/1979 U.S.S.R. .

*Primary Examiner*—Henry A. Bennett
*Assistant Examiner*—Pamela A. O'Connor
*Attorney, Agent, or Firm*—Price, Heneveld, Cooper, DeWitt and Litton

[57] ABSTRACT

An impactor for a movable, deformable barrier, simulating an automobile, comprising an upright, solid backing support, a plurality of energy absorbing impact segments protruding from the support, each segment having an outer impact face and each comprising a plurality of layers of honeycomb having different crush strength characterized by increasing crush strength of successive layers from the outer impact face to the support, the layers being separated by and secured to perforate plates therebetween allowing air flow from a crushing layer to the succeeding layers when the layers are successively crushed and each impact segment having a thin vent layer of noncrushing slotted honeycomb adjacent the support for discharge of air from all of the segments as they are successively crushed. The layers in each segment are of essentially the same width and height. The layers in each segment, except for the vent layer, are individually precrushed sufficient to eliminate the initial compression load spike, and portions of the precrushed faces of the honeycomb layers have recesses resulting in reduced physical face area. The recesses are preferably formed by precrushing.

10 Claims, 6 Drawing Sheets

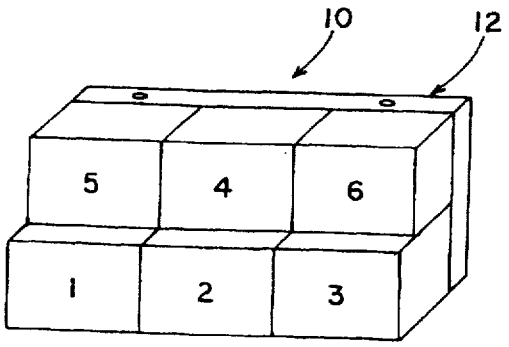
FIG. 1
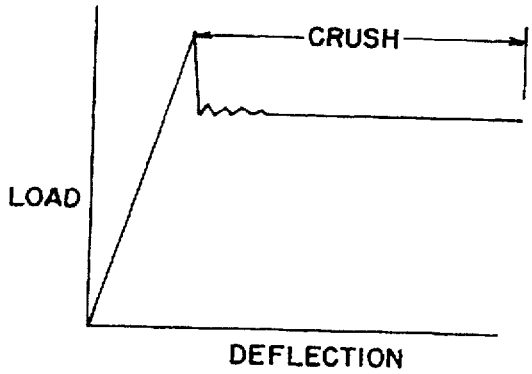
FIG. 2
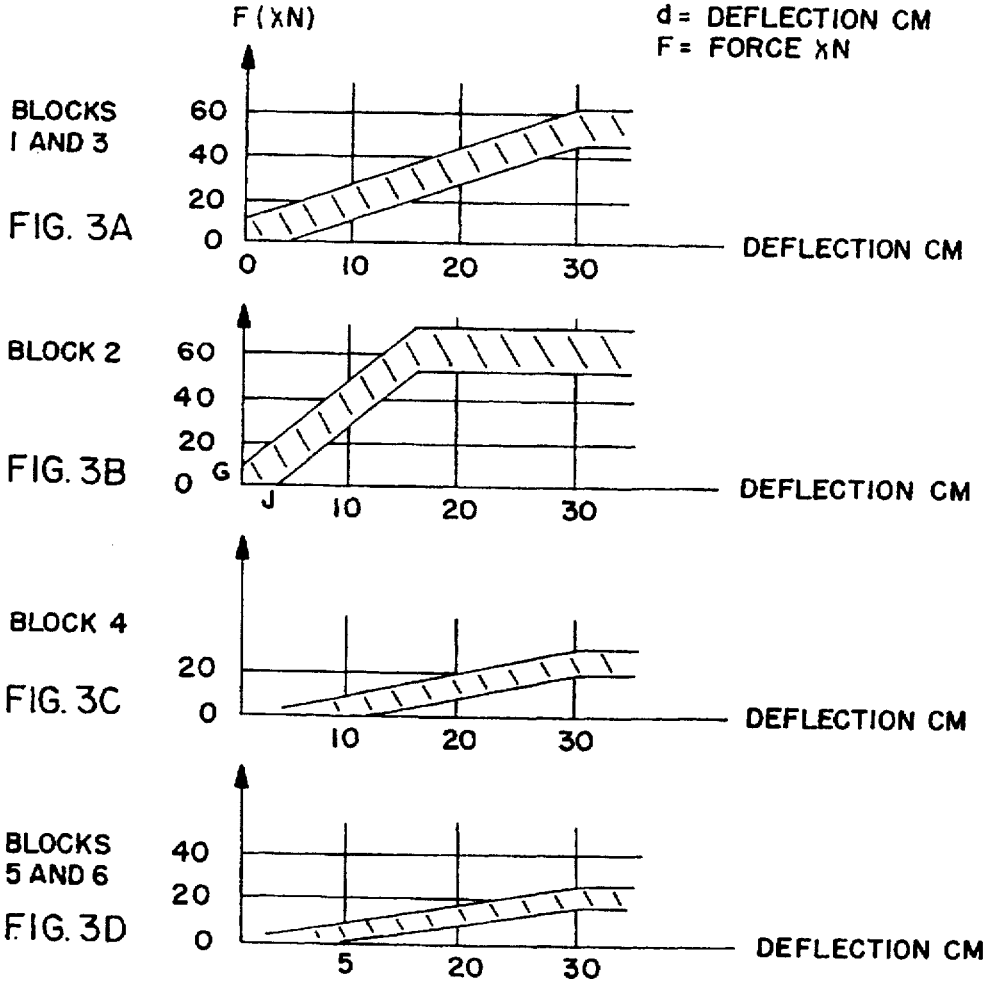

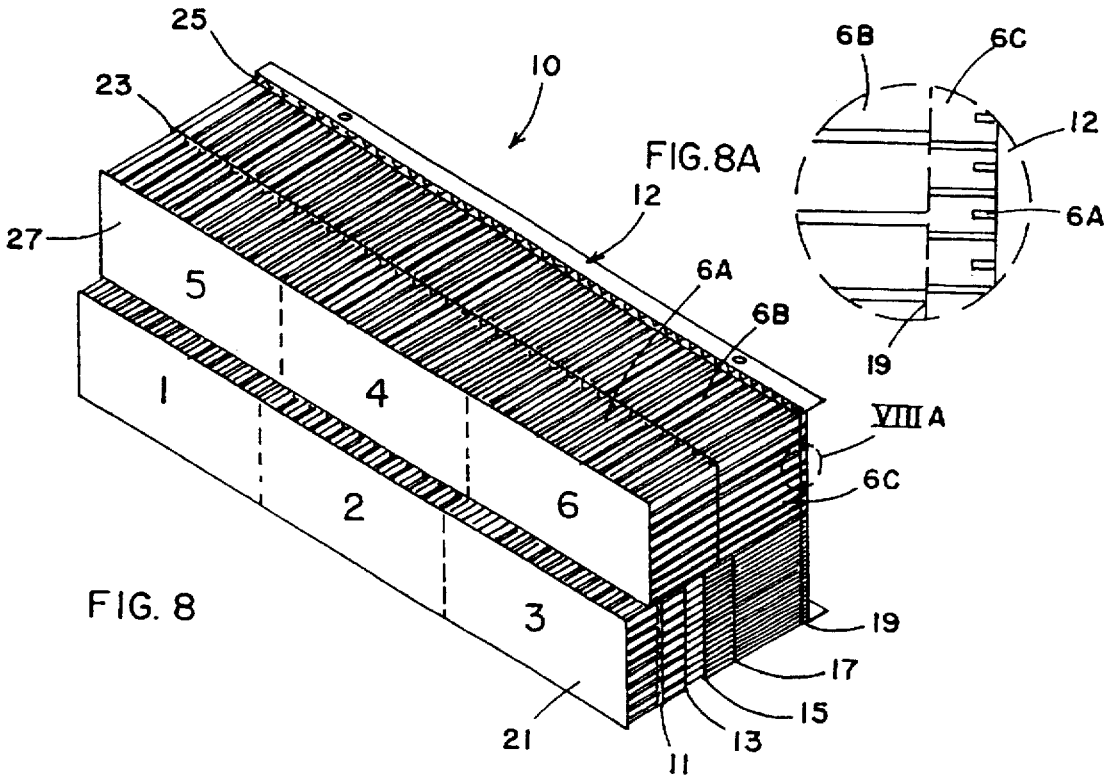
FIG. 8A
FIG. 8
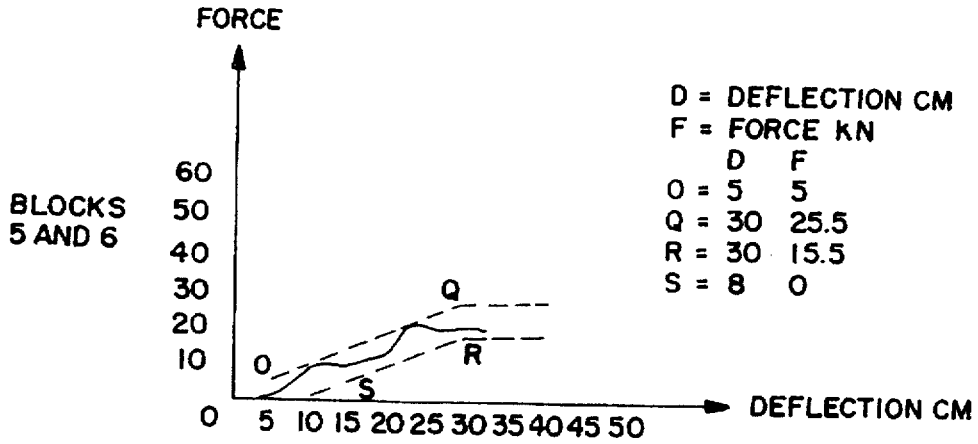
FIG. 7D

DEFORMABLE IMPACT TEST BARRIER

RELATED APPLICATIONS

This application is a continuation-in-part application of application Ser. No. 08/536,058, filed Sep. 29, 1995, now U.S. Pat. No. 5,620,276.

BACKGROUND OF THE INVENTION

This invention relates to a movable, deformable barrier simulating the front end of an automobile for crash safety evaluation.

A movable deformable barrier (MDB), i.e., impactor, is known to be used to simulate the front end of an automobile for the purpose of crash safety evaluation. The manner of usage of the MDB is to propel the MDB into an actual automobile, typically into the side of the automobile, to impact test the side of the actual automobile for safety evaluation. The MDB must first be certified as satisfactorily simulating the front end of an actual automobile. To do this, the MDB is first mounted on a mobile sled and propelled at a predetermined specified speed for impact against a solid wall having load cells thereon. The load cells and accompanying accelerometers detect the energy absorbed by each of the segments of the MI)B as it crushes, and detect the total energy absorbed by the MDB by all of its segments. If the MDB meets the predetermined specified energy absorption criteria, it is certified, then duplicates of the MDB can be used for tests. I.e., the MDB is mounted on the mobile sled and used to simulate the front end of an automobile in a crash against an actual automobile. Thus, an actual automobile to be tested is substituted for the solid wall, and the MDB crashed into the actual automobile, typically into the side thereof, to test the safety characteristics of the side doors, etc. of the automobile. To make a meaningful crash test, the MDB must have load deflection characteristics that are reasonably consistent with those of a standard size automobile. For automobiles in Europe, these characteristics have been previously determined by a European governing body and are indicated in published specifications (see FIGS. 3*a*–3 *d*). The specified load deflection characteristics of the MDB have also been broken down into six segments, three in a lower row and three above them in an upper row.

During certification action, the load cell wall has specific load cell zones to measure the load generated by each corresponding section of the MDB. Thus, the load cell wall is also divided into a plurality of areas, typically six areas, with independent load cells in these areas. The energy absorption data for each load cell area must fall within the maximum and minimum boundaries of the graphical representation of the limits specified by the governing body for these areas (FIGS. 3*a*–3*d*), and the energy absorption data for the total of these load cell areas must fall within the maximum and minimum boundaries of the graph specified for the total (FIG. 3).

MDB's have been known to be made of honeycomb material. The use of honeycomb as an energy absorbing material is well known because of its uniform, consistent and predictable crush characteristics. The load deflection curve of honeycomb is actually flat after the initial deformation spike. That is to say that the resultant force generated by a section of honeycomb will remain basically constant over the entire distance of crush, as shown in FIG. 2. However, the load deflection curve specified for the MDB is not flat. Instead it ramps up at a constant rate, then levels off (FIGS. 3*a*–3*d* and 3). A known method for generating this type of force deflection curve is to shape the core to varying dimensions such that the area being crushed is proportional to the force desired by providing a pyramid shaped section of honeycomb as shown in FIG. 4. While this may generally accomplish objectives of the governmental specifications, it also generates problems. Firstly, since the load is only generated at the point of contact between the shaped honeycomb and the barrier wall, there are some areas where the local crush load may be undesirably high so as to be outside of the specifications for the individual segments (FIGS. 3*a*–3*d*). This is so even though the average over the load cell wall sections may be within the "total" force specifications limits (FIG. 3). Automobiles, however, are not homogeneous structures. There are various hard spots and soft spots in an automobile structure. Depending on where the MDB with the prior art shaped honeycomb strikes the vehicle, therefore, there can be a variety of different results. If a hard spot of the MDB were to strike a soft part of the automobile, there might be considerable penetration into the vehicle. If a hard spot on the MDB were to come into contact with a hard spot on the car, the distortion might be minimal. Secondly, the side loads generated during the impact may tend to shear the prior art core because of its small cross sectional area, resulting in unpredictable crush values.

Another prior art device is an element consisting of six single blocks of polyurethane foam with different densities. To obtain desired force to deflection characteristic, parts of the material were cut out at the rear side (barrier side) as shown in FIG. 4*a*.

The invention described and claimed in parent application Ser. No. 08/536,058 provides significant functional improvement over the known prior art devices. In some situations, however, the test results have shown an errant curve that briefly extends outside the specified limits. More specifically, the theoretical pattern in FIG. 9*a* is expected to result in the actual pattern in FIG. 9*c*, but might result in the pattern in FIG. 9*b* where a small portion of the curve is shown to extend slightly above the upper limit boundary. This has been found to potentially occur at the beginning of crush of a layer.

SUMMARY OF THE INVENTION

The present improvement was devised to assure maintenance of the load displacement curve within the specified boundaries without momentary movement past the limit boundaries. This is done with a variation of the previously disclosed system.

To accomplish this, a face, preferably the front face, of at least one, and typically some of the slices of honeycomb bonded into a single structure for each plate (FIG. 5) have limited indentation zones which cause a more gradual buildup of crush strength as the deformation of that layer is initiated. The overall force required to crush the layer is reduced by reducing the physical area of a portion of the layer. This can be done during a precrushing operation by further precrushing the portions of the face area of the layer to a predetermined depth. Or the recesses can be formed by cutting out these portions to a predetermined depth. As with the device in the parent application, each layer is separated from the adjacent layer by a perforated sheet of metal which allows air from the crushing shell layer to flow into the next layer. These layers are preferably of uniform width and height, with varying crush strengths and thickness. As before, the final inner honeycomb layer which is mounted against a plate is a thin section of noncrushing, laterally vented honeycomb, preferably slotted honeycomb, allowing air from the other layers to vent through this final layer and thereby prevent internal air pressure buildup in the honeycomb cells. The layers of each segment of the impactor have the same width and height as the other layers in the segment. The perforated sheets and slotted honeycomb layer provide ventilation and prevent distortion of energy absorption during impact. During such impact, the volume of the MDB decreases in proportion to the crushed distance. The layered structure described provides proper venting from the layers of honeycomb. Without allowing the air inside the MDB to escape, the pressure would build up rapidly such that if the layers were sealed, without venting to allow air to escape, the rapid pressure rise would be proportional to the crush of the individual layers. Thus, when the pressure inside the honeycomb layer exceeded the crush strength of the succeeding honeycomb layer, that succeeding layer would begin to crush even though the previous layer had not reached its full crush distance. This would cause improper and misleading data to result.

By combining these layers in a fashion with progressively increasing crush resistance, yet of the same width and height, and effecting the venting through the perforated separated sheets and final, noncrushing, side vented layer, it is possible to generate a stair step type of crush curve that stays within the boundaries specified for each segment, as generally depicted in FIG. 6, and without the disadvantages of the prior art shaped MDB. Each layer crushes uniformly throughout its thickness until it reaches its maximum crush distance. At that point the load increases until it exceeds the minimum crush strength of the following layer, which will then begin to crush, and so on through the entire range of the MDB, the energy absorption creating something like a stair step appearance as graphically illustrated in FIGS. *7a–7d*. The total energy absorption of all the segments is depicted in FIG. 7. For each segment there is a different combination of honeycomb types and thicknesses designed to allow the load deflection to match the corresponding curve. A key is in controlling the crush strength of the layers of honeycomb. Crush strength of honeycomb is mainly a function of the material, density, and material properties. The distance that honeycomb can be crushed before it reaches its maximum crush distance is about 80% of its original thickness for core over one inch thick. Therefore, honeycomb layers are selected to give a predetermined resistance to crush as set forth in chart A. The individual segments so formed are combined into the plural segment, normally six segment, MDB in FIG. 8, the back face being secured to a solid backing as of metal, and the front face being enclosed by a thin solid face sheet as of metal.

Some advantages of the layered honeycomb over the shaped prior art honeycomb are as follows:

1. Uniform impact resistance over entire surface (no hard or soft spots);
2. Resistance to the effects of lateral shear;
3. Structural integrity (less likely to disintegrate during impact).

Aspects of design:

1. Successive layers of honeycomb sheets with progressively higher crush strengths;
2. Each layer is separated from and attached to the next by a perforated sheet;
3. The last, i.e., core, layer of honeycomb is laterally slotted and higher in compressive strength than anticipated loading;
4. Perforated sheets and slotted core layer provide passage for air to exit the honeycomb to prevent pressure buildup during impact;
5. Honeycomb does not need to be perforated, except the slotted core layer;
6. Honeycomb layers may each be readily prefailed, i.e., precrushed, to eliminate the initial compression load spike in load deflection curve;
7. The precrushing step includes selected extra precrushing of facial portions of at least some layers to reduce required initial crush force at those layers and thereby keep the load deflection curve within prescribed boundaries.
8. Solid facing sheet distributes loading evenly and stiffens structure while providing uniform appearance; and
9. The construction is recyclable if of like materials such as metal, paper and/or thermoplastics.

BRIEF DESCRIPTION OF THE DRAWINGS

FIG. 1 is a perspective view of a movable deformable barrier;

FIG. 2 is a graph diagram of a load versus deflection curve of a honeycomb layer;

Figure 3:
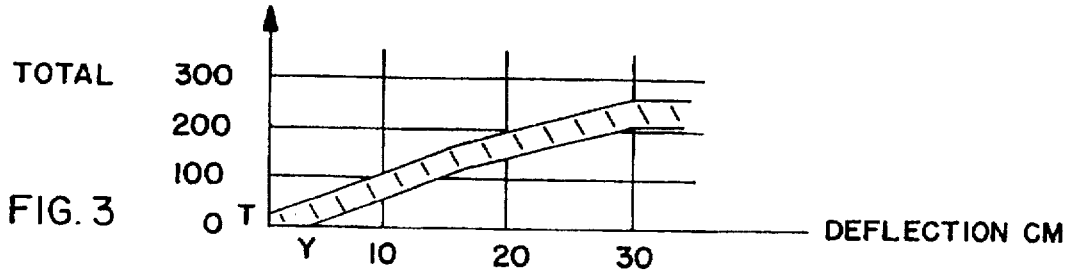
FIG. 3 is a graph of specified combined ranges of characteristics of the total movable deformable barrier.
Figure 5:
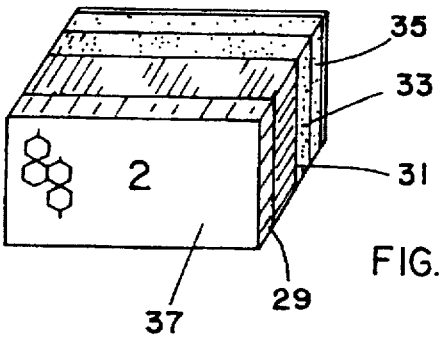
Figure 4:
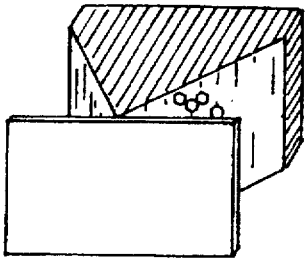
FIG. 4 PRIOR ART
Figure 6:
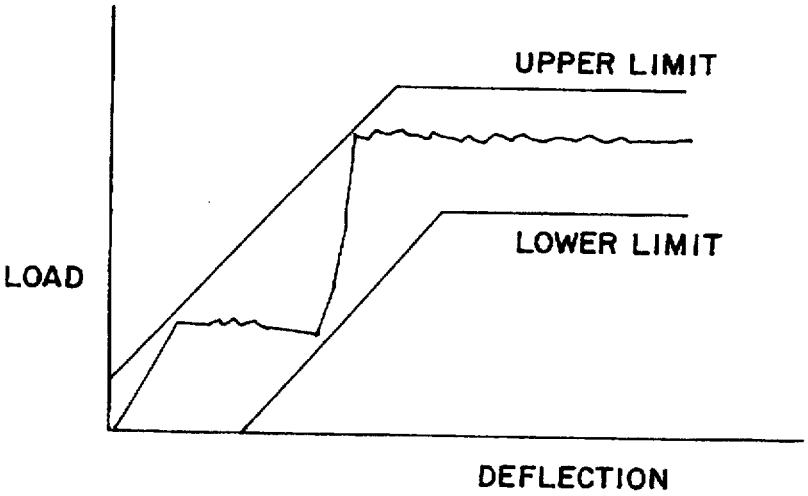
Figure 7:
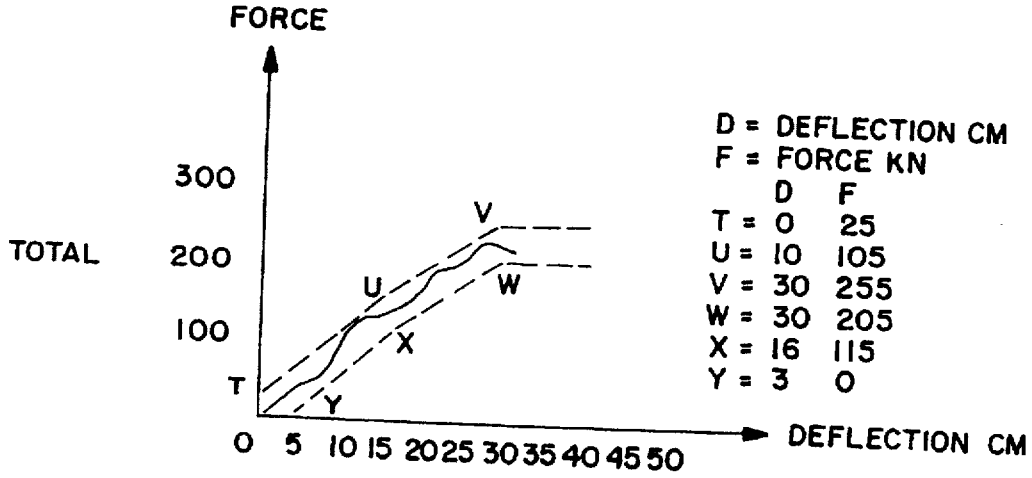
Figure 4A:
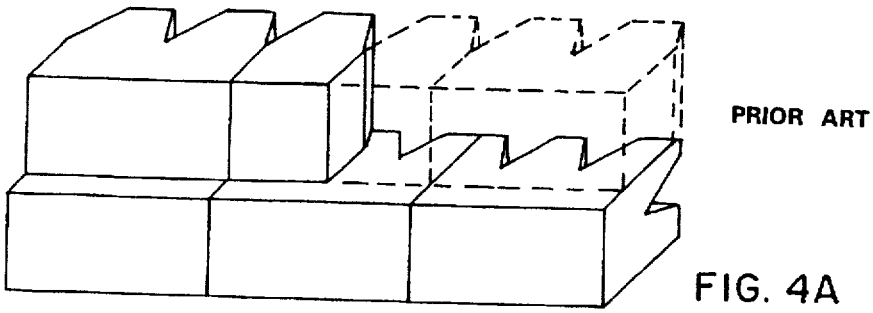
Figure 10:
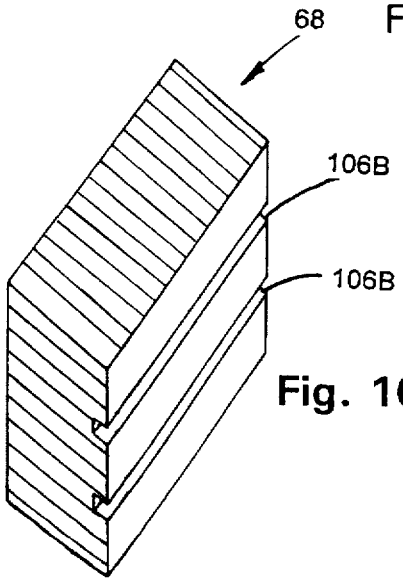
Figure 9A:
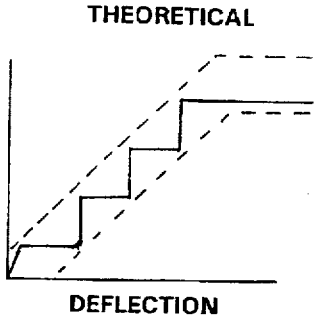
Figure 9B:
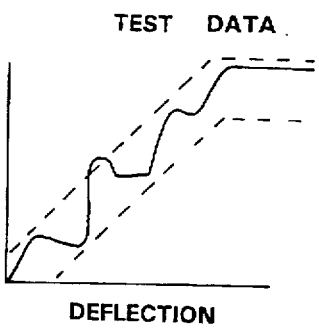
Figure 8B:
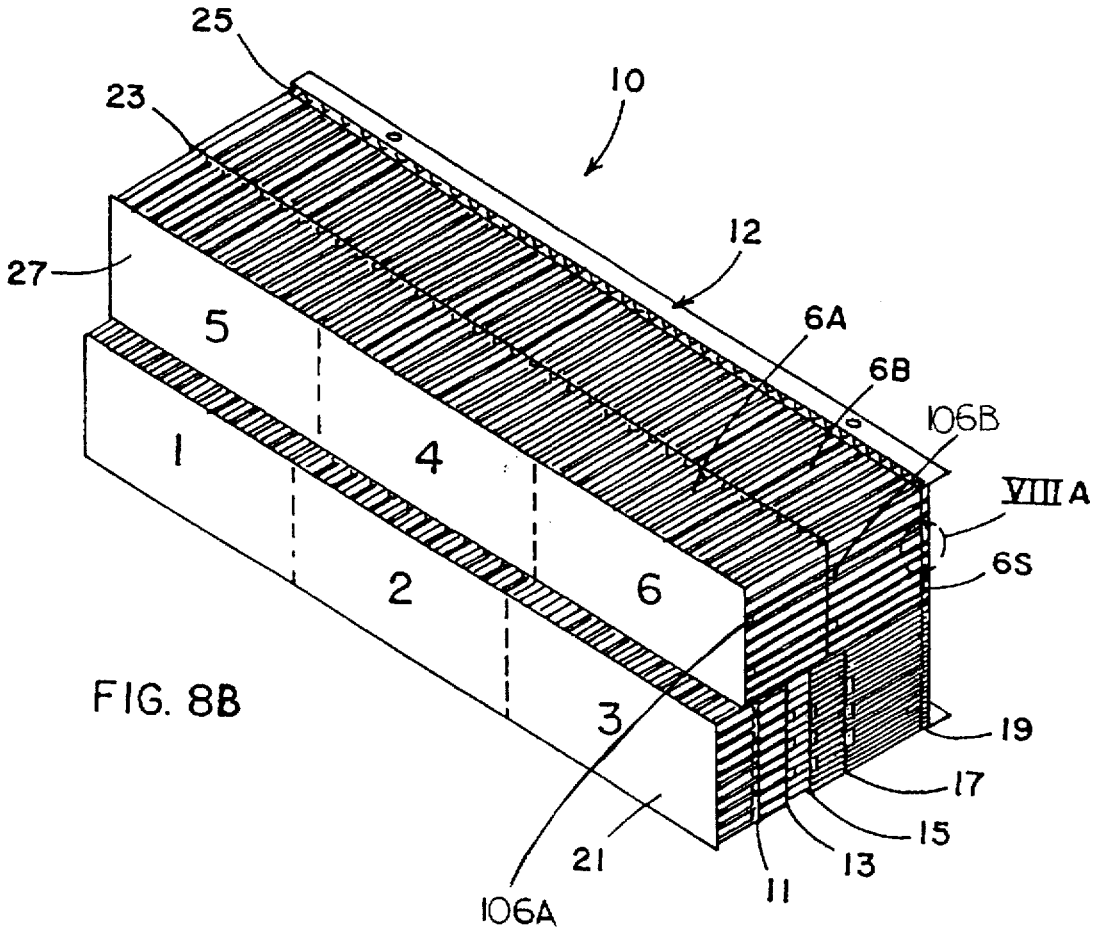
Figure 9C:
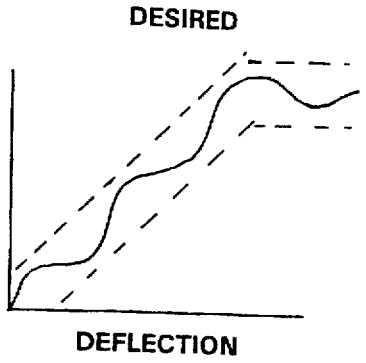

FIGS. *3a–3d* are graphs of specified characteristic ranges for segments of a movable deformable barrier;

FIG. 4 is a perspective view of a prior art barrier;

FIG. *4a* is a perspective view of another prior art barrier;

FIG. 5 is a perspective view of one segment of the novel barrier;

FIG. 6 is a graph of the load versus deflection curve illustrating a stair-step curve within the upper and lower specified limits;

FIG. 7 is a graph of the total combined characteristics of the novel barrier relative to the specified range of characteristics;

FIGS. *7a–7d* are graphs of characteristics of the novel barrier relative to specified ranges thereof;

FIG. 8 is a perspective view of the novel movable deformable barrier;

FIG. *8a* is a fragmentary enlarged sectional view of a portion of the MDB in FIG. 8;

FIG. *8b* is a perspective view of a deformable barrier incorporating the improvement;

FIG. *9a* is a graph of a theoretical load vs. deflection curve;

FIG. *9b* is a graph of a test load vs. deflection curve on an impactor without the present improvement and where the curve briefly extended out of the specified limits;

FIG. *9c* is a graph of the desired load vs. deflection curve to be obtained from the improved impactor; and FIG. 10 is a perspective view of one layer showing facial indentation portions.

DESCRIPTION OF THE PREFERRED EMBODIMENT

Referring now specifically to the drawings, the figures depict an MDB 10 formed of a plurality of segments, here shown to be six in number, with the segments being grouped in two rows, one above the other. The segments 1, 2 and 3 are shown in the bottom row in that order, with segments 5, 4 and 6 in the top row in that order, segment 5 being above 1, segment 4 being above 2, and segment 6 being above 3. These segments are all mounted on a rigid vertical support panel 12 capable of being mounted to a conventional movable sled (not shown). This panel is typically of metal which is alone or in combination with a further backup support is sufficiently rigid so as to not buckle or bend significantly when impacting the MDB against an automobile being tested. The sled employed for this purpose is conventional and therefore not shown. The individual segments 1–6 of the MDB are mounted to panel 12 to form the assembly 10. In the preferred embodiment depicted, segments 1 and 3 each comprise six layers, segments 4, 5 and 6 each comprise three layers, and segment 2 comprises five layers. The honeycomb cells in each layer are oriented axially to the impact, i.e., normal to support 12 and to the front cover sheet of each segment. Characteristics of these layers are set forth in chart form hereafter. Each of these layers is preferably precrushed a small amount prior to assembly, sufficient to obviate the typical compression spike illustrated at the left end of the graph curve in FIG. 2. Therefore, further crush of each layer of honeycomb under a force greater than the resistance force generated by each layer of honeycomb will be basically constant over the entire distance of crush for that layer. By combining several layers of equal width and height, but of differing thicknesses and other characteristics such as density, i.e., number and size of honeycomb cells, and alloy and temper of the foil, it is possible to create a segment wherein the first layer will crush to its maximum of approximately 80% of its thickness, then the second layer crush to approximately 80% of its thickness, and so on through the third and successive layers except for the very last layer which in each segment comprises a thin honeycomb layer having a strength greater than the anticipated force in the impact test, so that this last layer does not crush. This last core layer is laterally vented, preferably by having laterally slotted honeycomb cells, so that it can vent the air being forced from each of the other layers and thereby prevent distorted readings and effects which would be caused by trapped air pressure within the crushing honeycomb layers. For example, referring to FIG. 8 and segment 6 therein, this segment has three layers 6A, 6B and 6C, with the honeycomb cell size decreasing from layer 6A to 6C. Layer 6C has laterally slotted honeycomb cells as shown in enlarged fragmentary FIG. 8*a* at slots 6*s*.

Perforated support and bonding sheets, preferably of metal, are positioned between adjacent layers of honeycomb. Thus, for segments 1 and 3 there will be five such sheets, sheet 11 between the first and second layer, sheet 13 between the second and third layer, sheet 15 between the third and fourth layer, sheet 17 between the fourth and fifth layer, and sheet 19 between the fifth and sixth layer. The sixth layer is backed by the imperforate support plate 12. A thin cover sheet 21 is over the face of the first layer. Similarly, for segments 4, 5 and 6, there are two perforated separator sheets 23 and 25 between the first and second and second and third layers, respectively, the third layer being mounted on panel 12 and the first layer having a face sheet 27. Finally, segment 2 has four perforated separator sheets 29, 31, 33 and 35 between the successive layers, the rearwardmost layer being mounted on panel 12 and the forwardmost layer having a face covering sheet 37.

Figure 7A:
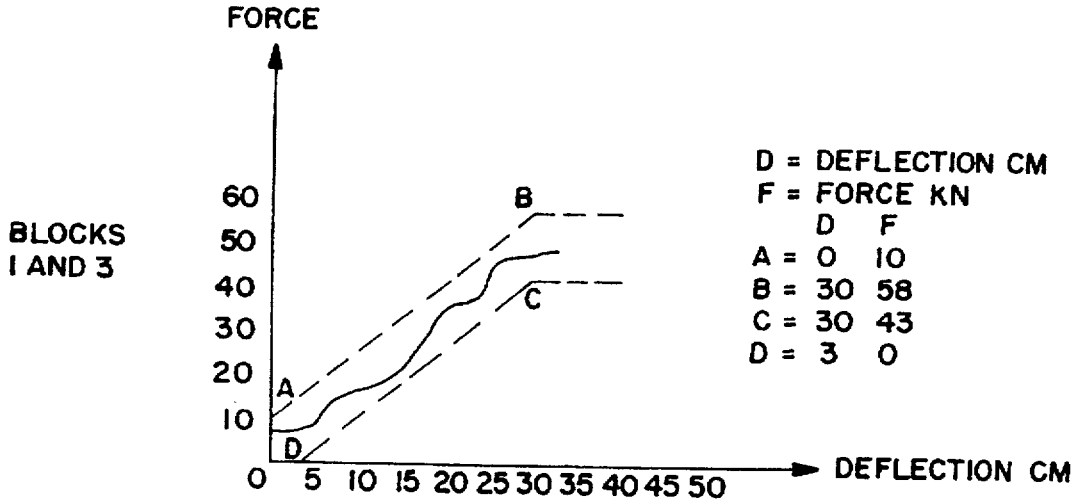
Figure 7B:
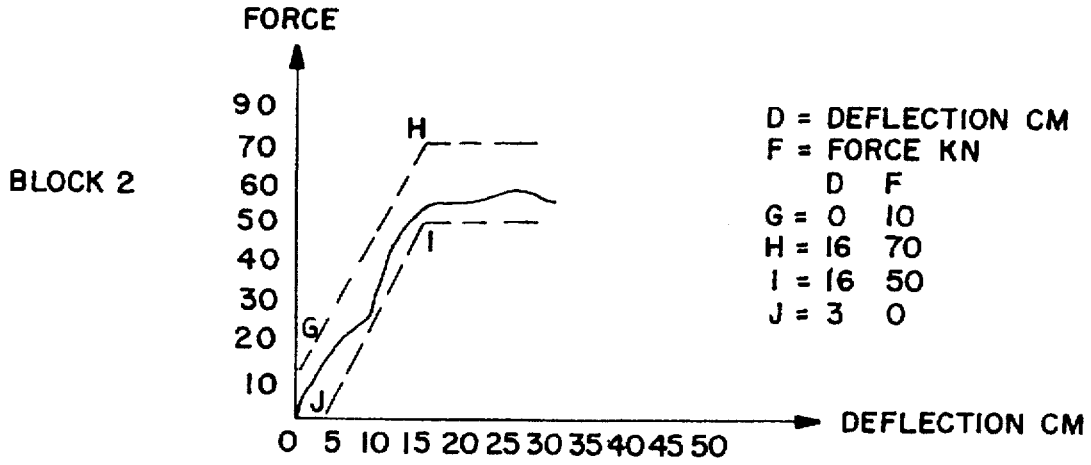
Figure 7C:
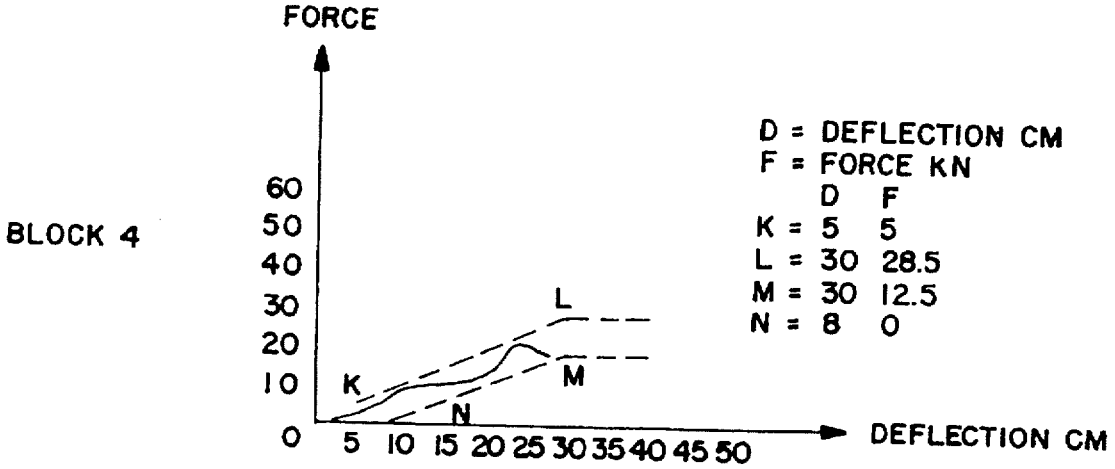

In use, the MDB mounted on a mobile sled is crashed into an automobile, such as into the side doors thereof, to evaluate the safety characteristics of the automobile. An MDB in accordance with this invention, assembled in the manner depicted in FIG. 8, was tested and found to have crush characteristics for the individual segments or blocks depicted in FIGS. 7*a*, 7*b*, 7*c* and 7*d*, with the combined total in FIG. 7. All of these graphs represent the results of dynamic testing except for the curve in FIG. 7*a* which was determined by a static test. The particular number of layers employed for each segment or block, and the characteristics of the particular layers of honeycomb, may be varied somewhat but still be capable of falling within the ascending maximum and minimum specification boundaries required for the individual segments or blocks. The illustrative embodiment depicted met the force-crush distance specifications of the European requirements and thus is preferred. The graph depicts the crush characteristics in centimeters of deflection per force in kilonewtons.

HONEYCOMB CORE MATERIALS FOR IMPACTOR

| Core Material | Cut Thickness | Pre-Crushed Thickness | Strength |
|---|---|---|---|
| | Impactor Segments 1, 3 | | |
| 1" cell | 4.000" | 3.75" | 8–12 psi crush |
| 1" cell | 2.750" | 2.50" | 16–20 psi crush |
| ¾" cell | 2.430" | 2.18" | 25–30 psi crush |
| ½" cell | 3.500" | 3.25" | 32–40 psi crush |
| ⅜" cell | 7.750" | 7.50" | 50–60 psi crush |
| ¼" cell | .500" | — | Slotted core, not crushed |
| | Impactor Segment 4, 5, 6 | | |
| 1" cell | 7.750" | 7.50" | 8–12 psi crush |
| 1" cell | 9.570" | 9.32" | 16–20 psi crush |
| ¼" cell | .500" | — | Slotted core, not crushed |
| | Impactor Segment 2 | | |
| 1" cell | 2.750" | 2.50" | 8–12 psi crush |
| 1" cell | 1.500" | 1.25" | 16–20 psi crush |
| ½" cell | 1.850" | 1.60" | 32–40 psi crush |
| ¾" cell | 13.980" | 13.83" | 50–60 psi crush |
| ¼" cell | .500" | — | Slotted core, not crushed |

The material was preferably that designated as alloy type 3003 aluminum, but it can be of other metals, paper and/or plastic.

Referring now to FIGS. 8*b*, 9*a*, 9*b*, 9*c* and 10, there is shown the improved version of the device wherein portions of the front face of several of the honeycomb layers are provided with transverse recesses to reduce the physical face area. This is preferably in the form of elongated recesses such as the pairs of recesses 106B in layer 6B (FIG. 8*b*), recesses 106A in layer 6A, and the exemplary trios of recesses in the honeycomb layers shown beneath layers 6A and 6B in FIG. 8*b*. These recesses are preferably formed during the precrushing operation previously described, as with a die having elongated impression bars on the face thereof, e.g., to a recess depth of about 15 mm. maximum. The area of the recesses is preferably no more than 10% of the total face area of the respective honeycomb layer into which they are formed. These recesses could alternatively be formed by cutting out the portions to form the recesses, e.g., by a milling cutter.

Conceivably those persons knowledgeable in this field of endeavor will, upon studying this disclosure, consider various modifications and/or improvements to the inventive concept presented, but still within this concept. Therefore, the invention herein is not to be limited to the preferred embodiments set forth as exemplary of the invention, but only by the scope of the claims and the equivalents thereto.

The embodiments of the invention in which an exclusive property or privilege is claimed are defined as follows:

1. An impactor for a movable, deformable barrier simulating an automobile, comprising:

an upright, solid backing support having a support face;

a plurality of energy absorbing impact segments protruding from said support face;

each said segment having an outer impact face and each comprising a plurality of layers of honeycomb having different crush strength characterized by increasing crush strength of successive layers from said outer impact face to said support;

said layers being separated by and secured to perforate plates therebetween allowing air flow from a crushing layer to the succeeding layers when said layers are successively crushed; and at least one of said layers having a face area characterized by recess portions reducing said face area.

2. The movable deformable barrier impactor in claim 1 wherein each impact segment has a thin vent layer adjacent said support for discharge of air from all of said segments as they are successively crushed.

3. The impactor for a movable deformable barrier in claim 2 wherein said vent layer comprises laterally vented honeycomb cells having a compression strength greater than the anticipated impact load.

4. The movable deformable barrier impactor in claim 3 wherein said laterally vented honeycomb is slotted honeycomb.

5. The movable deformable barrier impactor in claim 1 wherein said layers in each segment are of essentially the same width and height.

6. The impactor for a movable, deformable barrier in claim 5 wherein a plurality of said layers are so characterized.

7. The movable deformable barrier impactor in claim 5 wherein said layer has at least a pair of said recesses, and said recesses are elongated.

8. The movable deformable barrier impactor in claim 5 wherein said recesses constitute no more than 10% of said face area.

9. The movable deformable barrier impactor in claim 1 wherein said layers in each segment, except said vent layer, are individually precrushed sufficient to eliminate the initial compression load spike, and said recesses are precrushed.

10. The movable deformable barrier impactor in claim 1 wherein said layers of honeycomb are formed of at least one of the materials consisting of aluminum, plastic and paper.

* * * * *